US009011259B2

(12) United States Patent
Schmidt

(10) Patent No.: US 9,011,259 B2
(45) Date of Patent: Apr. 21, 2015

(54) PEOPLE MOVER

(71) Applicant: Jordan Michael Schmidt, Westwood, NJ (US)

(72) Inventor: Jordan Michael Schmidt, Westwood, NJ (US)

( * ) Notice: Subject to any disclaimer, the term of this patent is extended or adjusted under 35 U.S.C. 154(b) by 89 days.

(21) Appl. No.: 13/837,925

(22) Filed: Mar. 15, 2013

(65) Prior Publication Data

US 2014/0274431 A1 Sep. 18, 2014

(51) Int. Cl.
*A63G 31/16* (2006.01)
*A63G 31/00* (2006.01)

(52) U.S. Cl.
CPC ..... *A63G 31/00* (2013.01)

(58) Field of Classification Search
CPC ..... A63G 1/30; A63G 31/00; A63G 31/02; A63G 31/16; A63F 13/02; A63F 13/12
USPC ..... 472/49, 50, 59, 60, 75–78, 80, 130; 434/55, 247; 105/30, 148, 150, 151
See application file for complete search history.

(56) References Cited

U.S. PATENT DOCUMENTS

| | | | | |
|---|---|---|---|---|
| 5,931,740 | A | 8/1999 | Kitchen | |
| 6,017,276 | A | 1/2000 | Elson et al. | |
| 6,053,576 | A * | 4/2000 | Jessee | 297/344.19 |
| 6,406,299 | B1 * | 6/2002 | Murao et al. | 434/29 |
| 6,440,002 | B1 * | 8/2002 | Jackson | 472/118 |
| 8,147,344 | B2 * | 4/2012 | Crawford et al. | 472/59 |
| 8,166,885 | B2 | 5/2012 | Kitchen | |
| 2007/0278046 | A1 | 12/2007 | Hoffend, III | |

* cited by examiner

*Primary Examiner* — Kien Nguyen
(74) *Attorney, Agent, or Firm* — Tutunjian & Bietto, P.C.

(57) ABSTRACT

A people moving system having a people pod and a cable support system attached to the people pod. The cable support system supports the people pod in the air and includes cables that are each connected at one end to the people pod and each connected to their own respective motor/winch system at the other ends. A computer control system is in signal communication with the motor/winch systems and allows the same to move the people pod in three (3) dimensions.

9 Claims, 13 Drawing Sheets

PEOPLE MOVER

BACKGROUND

1. Field of the Invention

The present principles relate to a people mover. More particularly, it relates a people mover that moves in three-dimensions.

2. Description of Related Art People movers such as ski lifts and shuttle lifts, etc. are commonly used to move people up and down difficult terrains or over large canyons or across water ways. These people movers includes very high tensile strength cables that are strung between rolling tracks (or supports) at preset distances in order to move the attached people pod from an origination point to a destination point.

An amusement ride, such as a roller coaster can also be considered a people mover with the context of this disclosure. Amusement rides come in all shapes and sizes. Among the most popular of amusement rides is the rollercoaster. As will be appreciated, rollercoaster enthusiasts are always seeking that new thrill of a newly designed coaster.

Rollercoasters, in general, require a lot of real estate. That is, the amount of ground on which the coaster track system must be based is quite large, and often takes up a major part of an amusement park's available real estate. As such, the implementation of newer, larger and more exciting coasters in existing amusement parks is very difficult, and often times include the removal of older coasters to free up real estate and/or require the acquisition of additional real estate.

SUMMARY

According to an implementation, people moving system of the present principles eliminates the need for a track and is capable of moving people in three (3) dimensions.

According to another implementation, people moving system of the present principles is completely programmable to mimic and/or replicate a variety of experiences including, but not limited to amusement ride experiences. In this respect the people moving system of the present principles can mimic or replicate the experiences provided by any known roller coaster, without requiring a track or track assembly.

According to another implementation, the disclosed concepts for the people moving system can be used to move people through a sightseeing experience, such as, for example, a safari or through an amusement park in 3 dimensions, thus providing a more exciting and interactive experience foe the patrons of the amusement park.

This and other aspects of the present principles are achieved by a people moving system having a people pod with at least one seat and including means for securing at least one person in the at least one seat. A cable support system is connected to the people pod and suspends the same in the air. A control system is in communication with the cable support system and is configured to move the people pod in three dimensions by selectively controlling the cable support system.

These and other aspects, features and advantages of the present principles will become apparent from the following detailed description of exemplary embodiments, which is to be read in connection with the accompanying drawings.

BRIEF DESCRIPTION OF THE DRAWINGS

The present principles may be better understood in accordance with the following exemplary figures, in which.

DETAILED DESCRIPTION

Figure 1A:
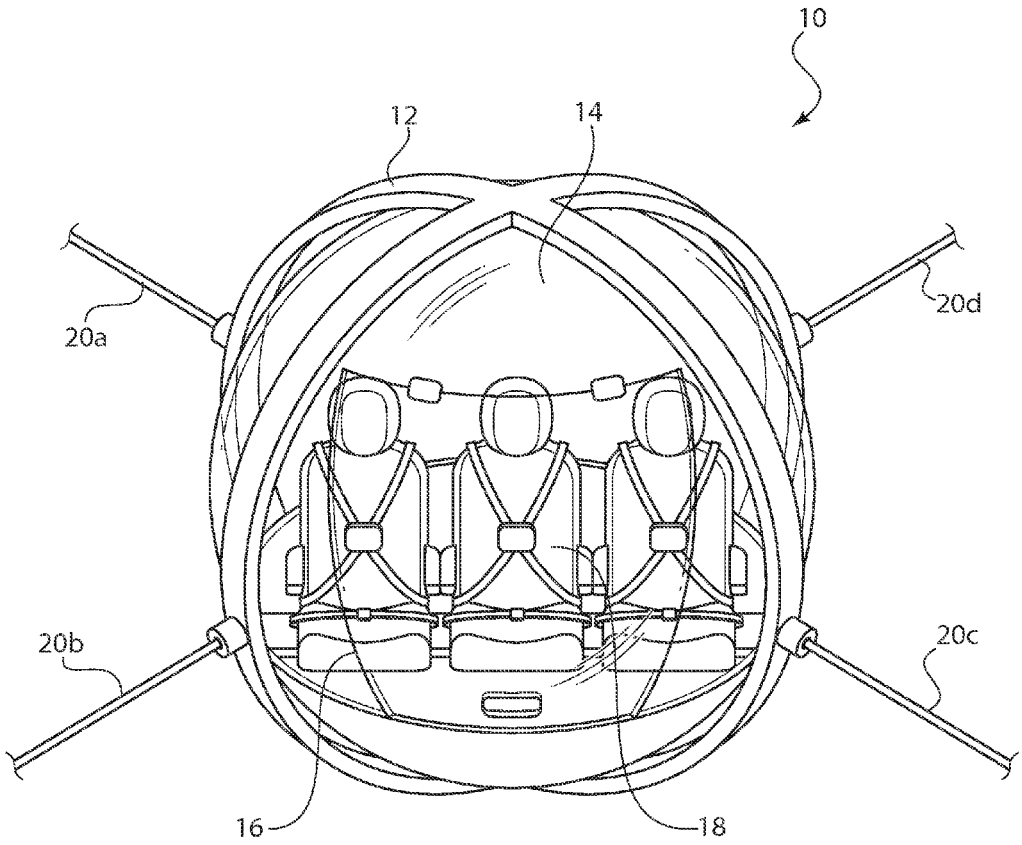
FIG. 1A is a perspective view of a person pod of the people moving system according to an implementation of the present principles.

The present principles are directed to people moving devices and systems and people moving system that operate in three (3) dimensions and which includes applications as an amusement ride.

The present description illustrates the present principles. It will thus be appreciated that those skilled in the art will be able to devise various arrangements that, although not explicitly described or shown herein, embody the present principles and are included within its spirit and scope.

All examples and conditional language recited herein are intended for pedagogical purposes to aid the reader in understanding the present principles and the concepts contributed by the inventor(s) to furthering the art, and are to be construed as being without limitation to such specifically recited examples and conditions.

Moreover, all statements herein reciting principles, aspects, and embodiments of the present principles, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Thus, for example, it will be appreciated by those skilled in the art that the block diagrams presented herein represent conceptual views of illustrative circuitry embodying the present principles. Similarly, it will be appreciated that any flow charts, flow diagrams, state transition diagrams, pseudocode, and the like represent various processes which may be substantially represented in computer readable media and so executed by a computer or processor, whether or not such computer or processor is explicitly shown.

The functions of the various elements shown in the figures may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor ("DSP") hardware, read-only memory ("ROM") for storing software, random access memory ("RAM"), and non-volatile storage.

Other hardware, conventional and/or custom, may also be included. Similarly, any switches shown in the figures are conceptual only. Their function may be carried out through the operation of program logic, through dedicated logic, through the interaction of program control and dedicated logic, or even manually, the particular technique being selectable by the implementer as more specifically understood from the context.

In the claims hereof, any element expressed as a means for performing a specified function is intended to encompass any way of performing that function including, for example, a) a combination of circuit elements that performs that function or b) software in any form, including, therefore, firmware, microcode or the like, combined with appropriate circuitry for executing that software to perform the function. The present principles as defined by such claims reside in the fact that the functionalities provided by the various recited means are combined and brought together in the manner which the claims call for. It is thus regarded that any means that can provide those functionalities are equivalent to those shown herein.

Reference in the specification to "one embodiment" or "an embodiment" of the present principles, as well as other variations thereof, means that a particular feature, structure, characteristic, and so forth described in connection with the embodiment is included in at least one embodiment of the present principles. Thus, the appearances of the phrase "in one embodiment" or "in an embodiment", as well any other variations, appearing in various places throughout the specification are not necessarily all referring to the same embodiment The present principles are now described in both in the context of an amusement ride and a people mover. For purposes of this disclosure, these terms are interchangeable. Accordingly the people moving system of the present principles can be used in a variety of settings, including, but not limited to, sightseeing tours, Safaris, and as an amusement ride capable of reproducing the ride experience of any other rollercoaster or other amusement ride that generally require a track, without requiring the track.

Referring to FIG. 1A, there is shown a people pod 10 according to an implementation. Pod 10 includes an outer frame 12, and an inner pod 14. The inner pod 14 includes an access door 16 and one or more seats 18 contained therein. The inner pod 14 is shown in this example as being completely transparent. In this implementation, the inner pod 14 can be rotatable within the outer frame 12. In this manner, the inner pod would include rollers or the like that engage the inside of the outer frame 12 such that the same can rotate freely within the same when not locked into position. In alternative configurations, the inner pod could be selectively moved within the outer frame by using rollers with servos and/or motors where such servos ore motors are in communication with the computer control system and controlled thereby.

Figure 1B:
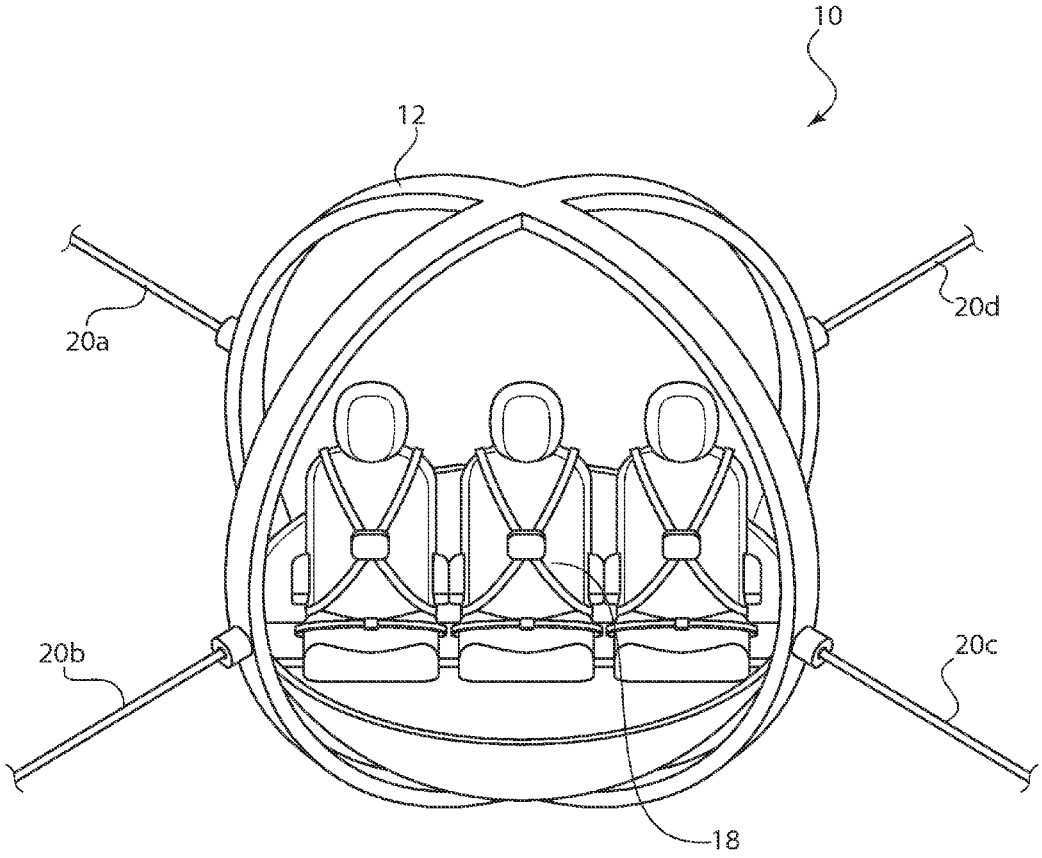
FIG. 1B is a perspective view of a person pod of the people moving system according to another implementation of the present principles.

However, in a preferred embodiment shown in FIG. 1B, the inner pod 14 is not required and the seats 16 can be secured to the outer frame 12 and be open to the air. In all embodiments discussed herein, the seats will have sufficient harnesses and/or seat belt configurations that are appropriate for the particular application, and which meet all safety standards and codes associated with such amusement rides and/or people moving systems.

Figure 2:
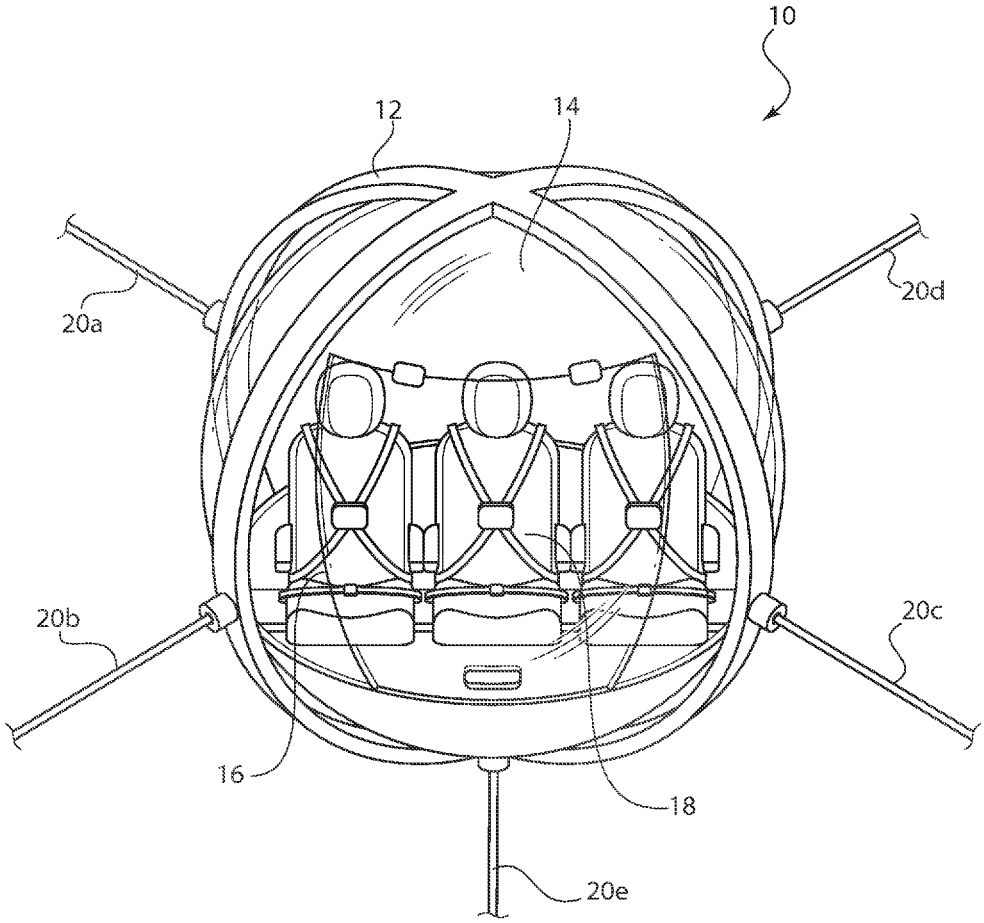
FIG. 2 is a perspective view of a person pod of the people moving system according to another implementation of the present principles.
Figure 3:
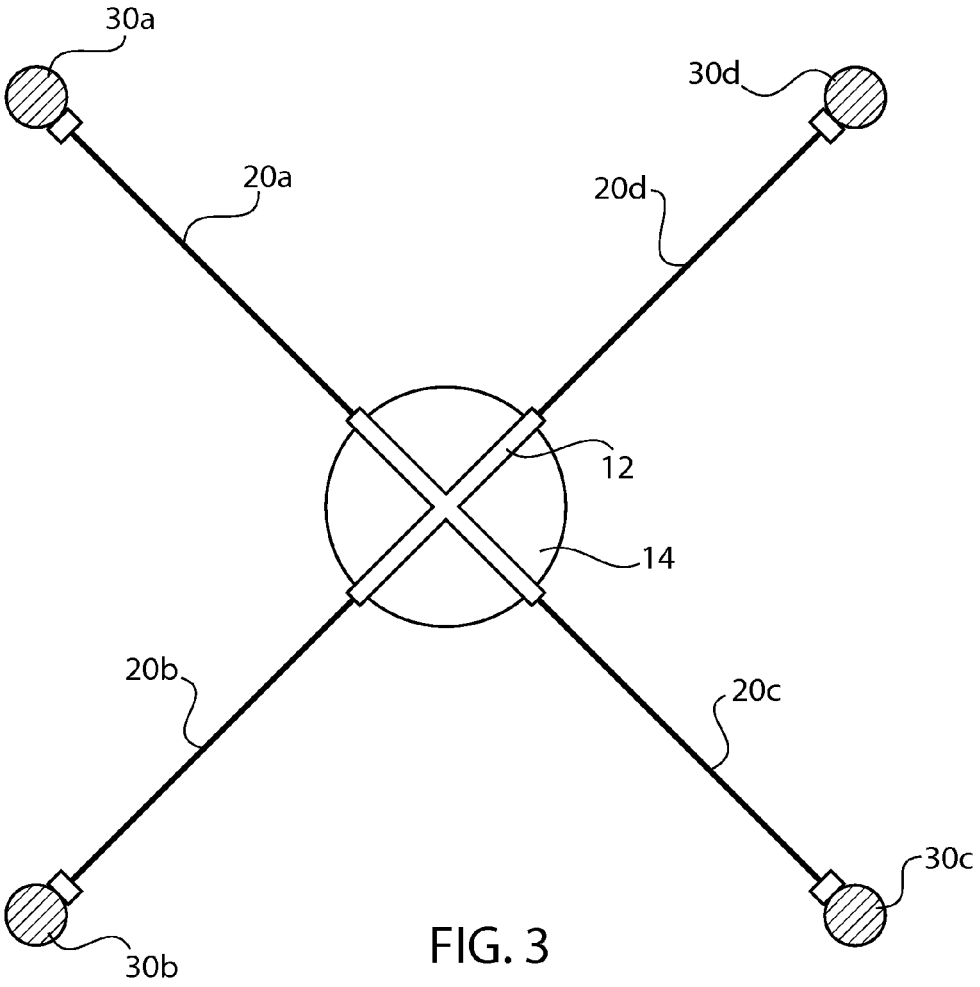
FIG. 3 is an overhead view of the people moving system according to one implementation of the present principles.

Referring to FIGS. 1-3, the outer frame of the people pod is connected to cables 20 in various different configurations. As shown in FIGS. 1A, 1B and 3, four (4) cables 20A-20D are connected to the outer frame 12 such that they are spaced from each other 90 degrees around the sphere of frame 12. Cables 20 are also preferably connected the frame 12 at a median point of the sphere. By pulling on and/or releasing tension on one or more of the cables 20 at different or the same rate of speeds, and using gravity as well when, the pod 10 can be moved in three-dimensions in an infinite combinations of ways. Further operation of the amusement ride will be described below.

According to a preferred implementation, the cables 20 are high tensile strength cables, similar to those used in chair lifts, ski lifts, or people moving systems that utilize cable supports and tracks. Cables of this nature are known and have been shown to have up to a 7 ton lifting capacity for a single cable. An example of a manufacturer of such cables suitable for application in the people moving system of the present principles would be, for example, Switzerland based Barthlot Maschinebau AG.

FIG. 2 shows a similar configuration as that of FIGS. 1A and 1B, with the addition of a fifth cable 20E connected to the bottom of the outer frame 12. In this configuration, the frame 12 can be pulled down at a speed faster than that provided by gravitational force.

Figure 4:
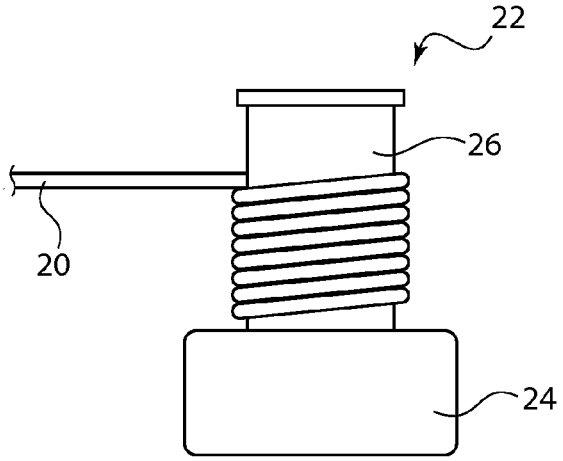
FIG. 4 is a plan view of a motor/winch arrangement of the cable support system according to an implementation of the present principles.
Figure 5:
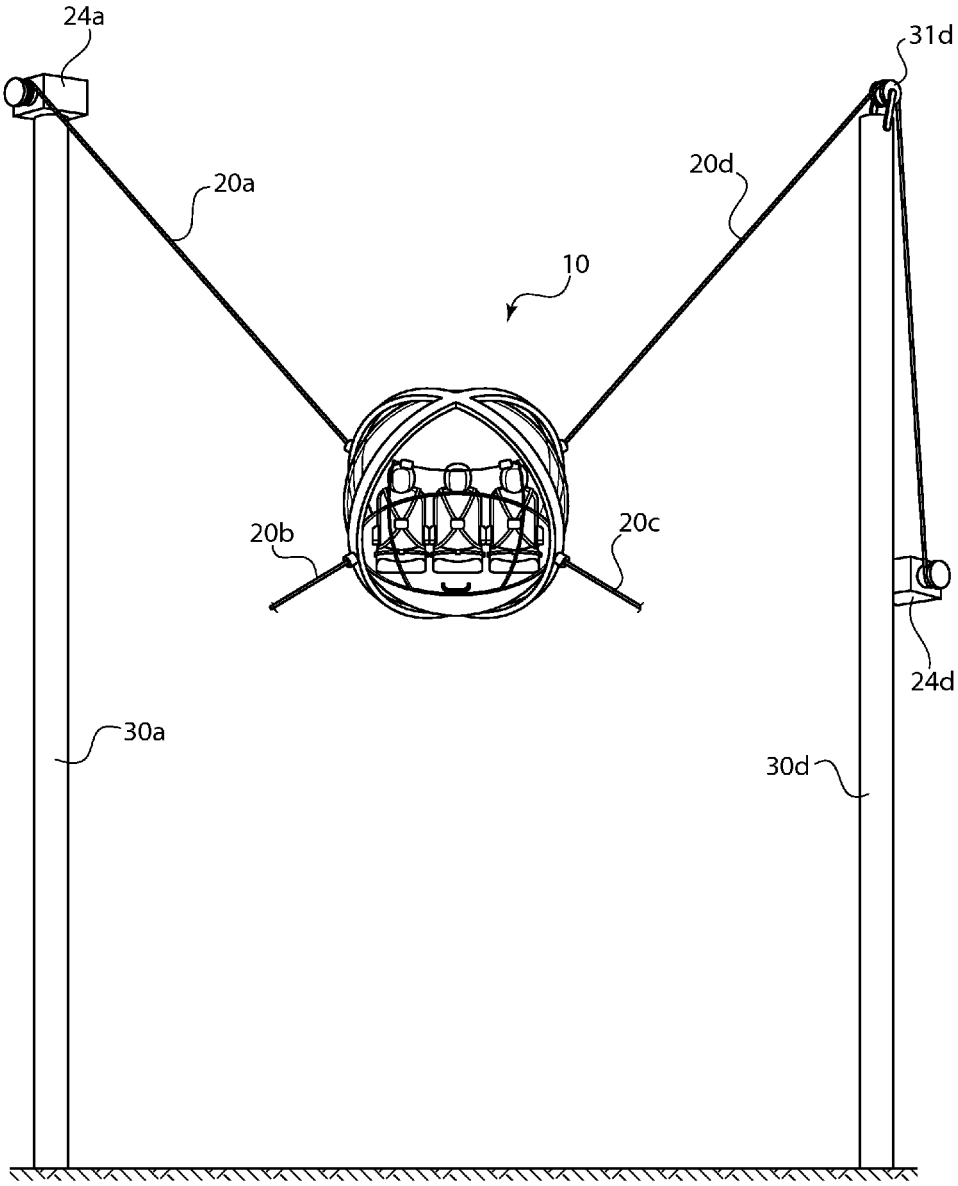
FIG. 5 is a side view of the people moving system according to an implementation of the present principles.

Referring to FIGS. 3-5, there is shown pod 10 (i.e. frame 12) suspended in space by having cables 20A-D connected to posts 30A-D, respectively. In this manner, posts 30 can be variably spaced apart to position the amusement ride over a park or other landscape suitable for the theme of the particular application of the ride. The distance between posts or supports 30 can be variable depending on desired applications. Although shown using posts 30, the points of connections for the cables 20 could include existing structures such as buildings or towers, thus eliminating the need to install or include posts 30 in order to set up a people moving system as disclosed herein.

According to preferred implementation, each cable 20 has its own associated control system 22, which includes a motor 24 and a winch like device 26 for reeling in and letting out cable 20. As shown in FIG. 5, the motors 24 can be mounted on the top of a post 30 (See post 30A and motor 24A), or alternatively, the motor 24D can be mounted at a lower point on the post 30D and include a pulley 31D at the top of the post. The lower mounting of the motor will assist in accessing the same for service.

Figure 6:
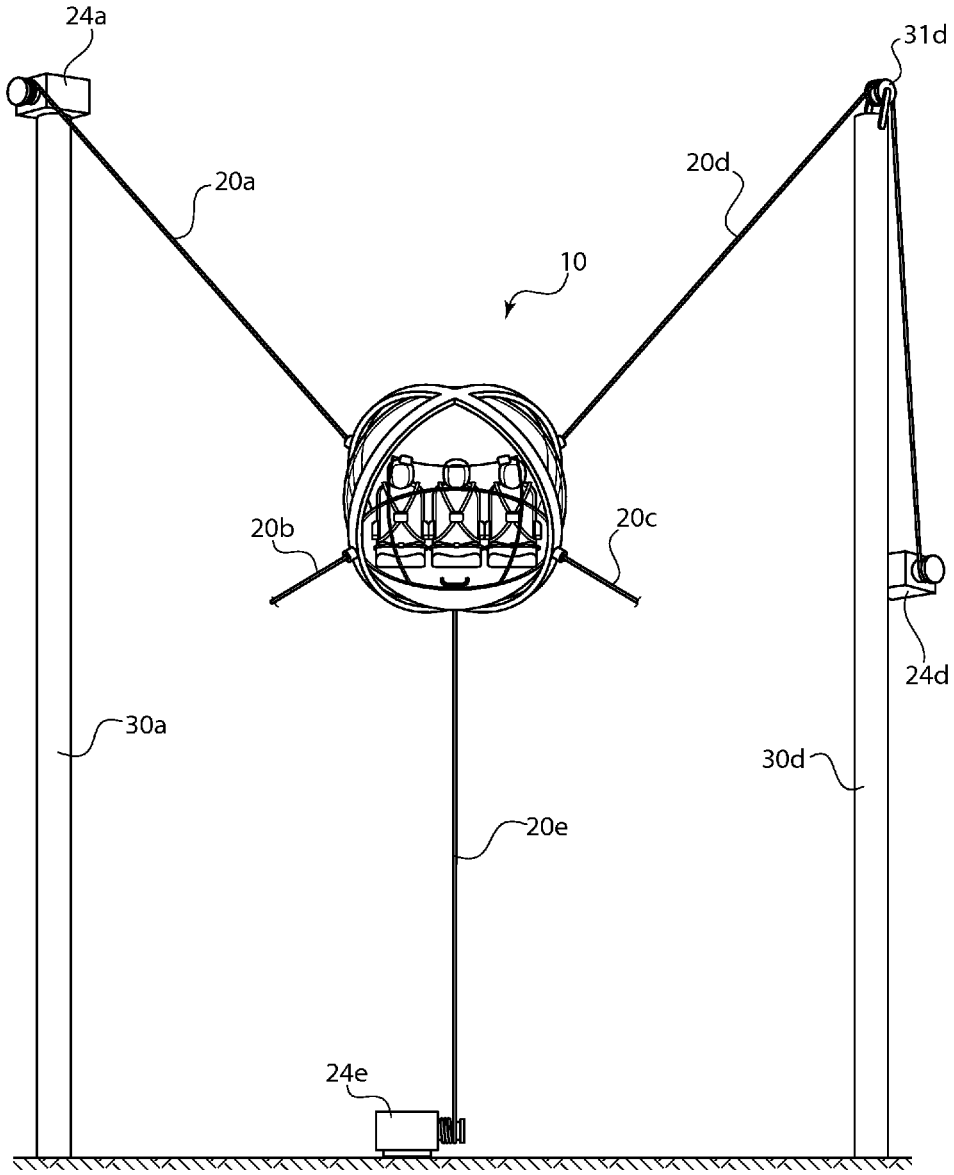
FIG. 6 is a side view of the people moving system according to another implementation of the present principles.

FIG. 6 shows the embodiment of FIG. 2, where a fifth cable 20E is attached to the bottom of the frame 12, and has its own associated motor.

Figure 7:
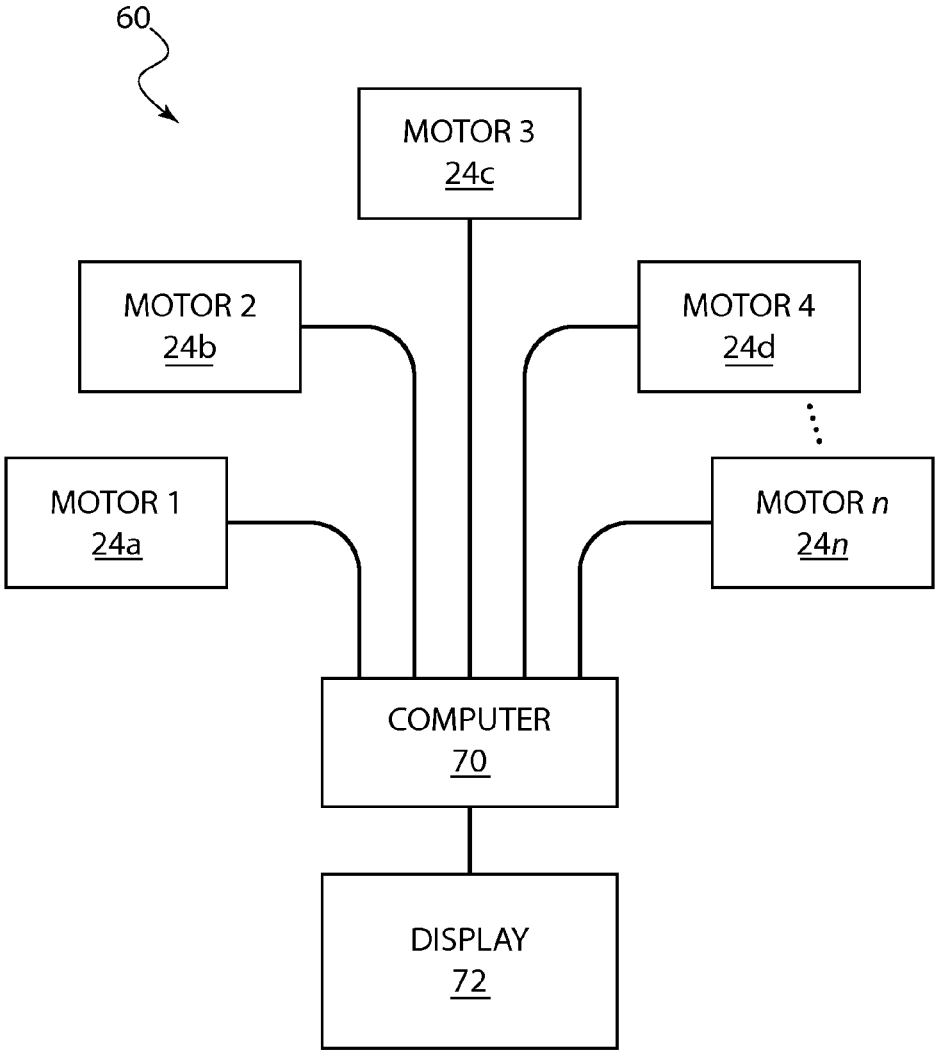
FIG. 7 is a block diagram of the control system for the people moving system according to an implementation of the present principles.

Referring to FIG. 7, there is shown a block diagram of the control system 60 for the amusement ride according to an implementation of the invention. A computer or processing device 70 is connected to the motors 24A-24N and has a connected display device to provide the use with a graphical user interface to control the amusement ride. The computer 70 will be programmed with suitable software that provides direct control to each of the motors and enables the individual control of the same.

As will be appreciated by the concepts disclosed herein, the computer 70 can be programmed with infinite different configurations for moving pod 10 according to a preferred motion. By way of example, computer 70 can be programmed to move pod 10 in three dimensions to allow the same to literally mimic the track of any existing roller coaster ride, without requiring a track and/or the real estate required for the same.

In operation, one of skill in the art will understand that the computer 70 will be programmed to instruct the motors 24 to pull on and/or release the pulling force on the connected cable at variable speeds, which will translate into the three dimensional movement of pod 10.

Figure 8:
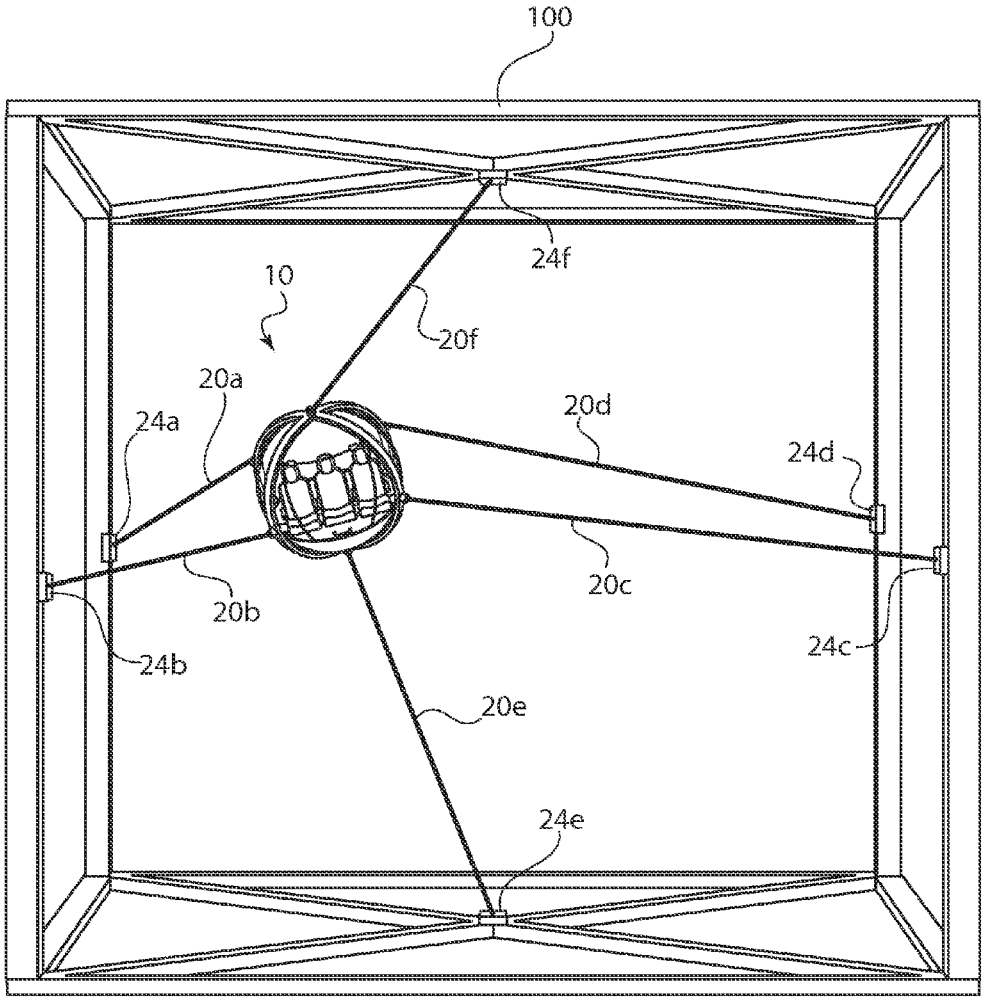
FIG. 8 is three dimensional view of an indoor implementation of people moving system according to the present principles.

FIG. 8 shows a completely self-contained version of the people moving system for use as an amusement ride according to another implementation of the invention. In this embodiment the people moving system is contained within a confined space such as a cage or enclosed room 100, and includes pod 10 suspended in air using up to six (6) cables 20A-20F. Less or more cables 20 could be removed or added, respectively depending on the desired application and/or intended effect of the ride. Each cable is connected to the corresponding motor 24 which, as explained above, is in signal communication with the computer control system.

FIGS. 9A-10B show another alternative implementation of the invention. In these embodiments, an open chairlift 35 design is utilized.

Figure 9A:
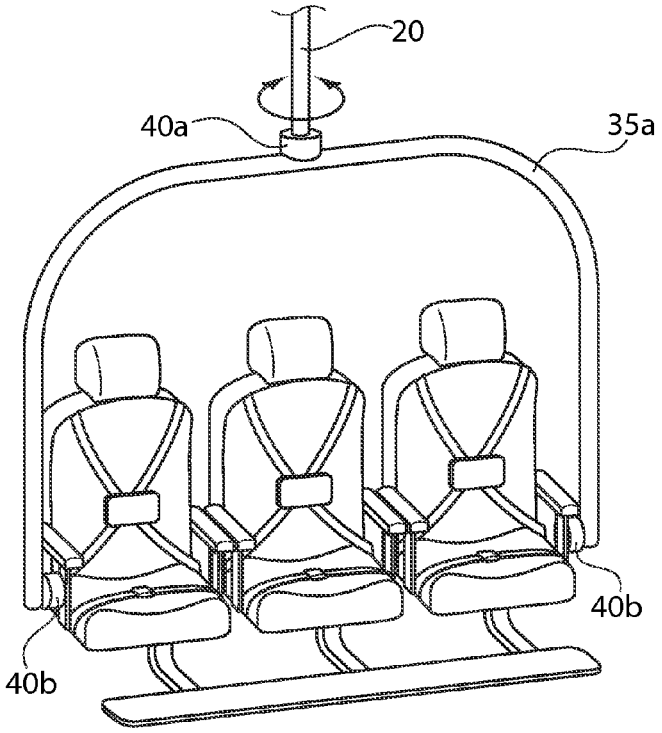
FIGS. 9A and 9B show an alternative implementation of the concepts of the people moving system according to another implementation of the present principles.

Referring to FIG. 9A, the chairlift 35A is connected to a cable 20 at the top thereof. Rotational connection points 40 are provided at the point of connection of cable 20 to the open chairlift 35, such that the chairlift can be rotated in either direction about that connection point. Also contemplated is the addition of rotation points 40B at a point below the seats. In this configuration, the entire row of seats can be rotated about these axis/connection points of rotation.

Figure 9B:
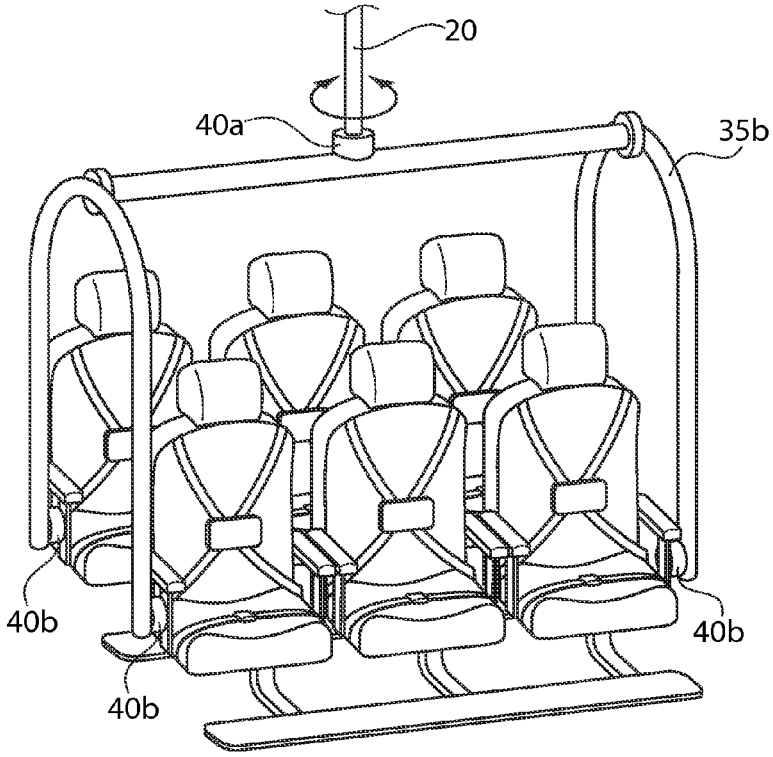

FIG. 9B shows another example of the chairlift design 35B, have two rows of seats. As with the previous embodiment, rotation points 40A and 40B provide the chairlift 35B with the ability to rotate about point 40A, while the seats can be rotated about the points 40B. It is further contemplated in these embodiments of FIGS. 9A and 9B, that the cable 20 is attached to a winch motor system 24 (not shown) which would allow the chairlift 35 to be lowered to the ground for any reason, including, but not limited to loading people on and off, emergencies, etc.

Figure 10A:
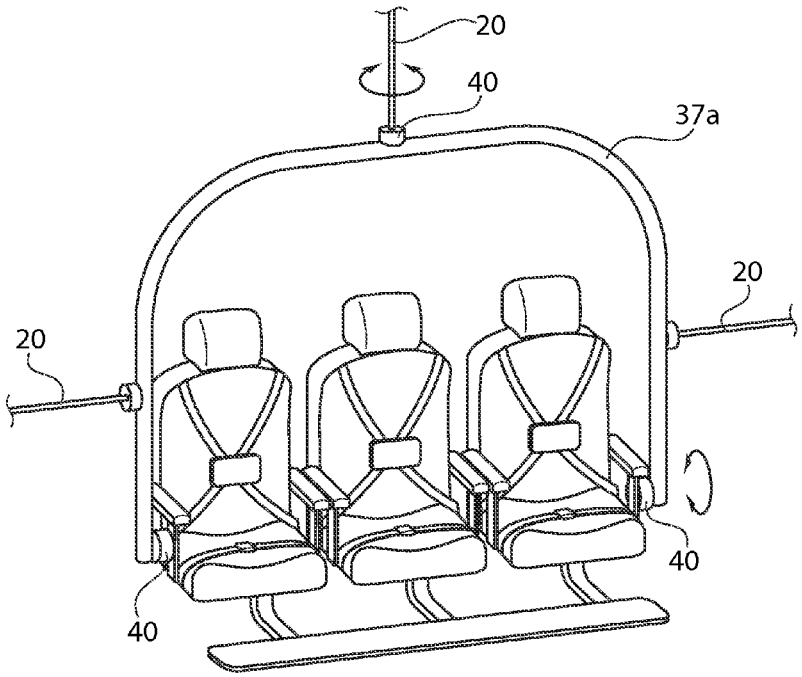
FIGS. 10A and 10B show another alternative implementation of the concepts of the people moving system according to the present principles.
Figure 10B:
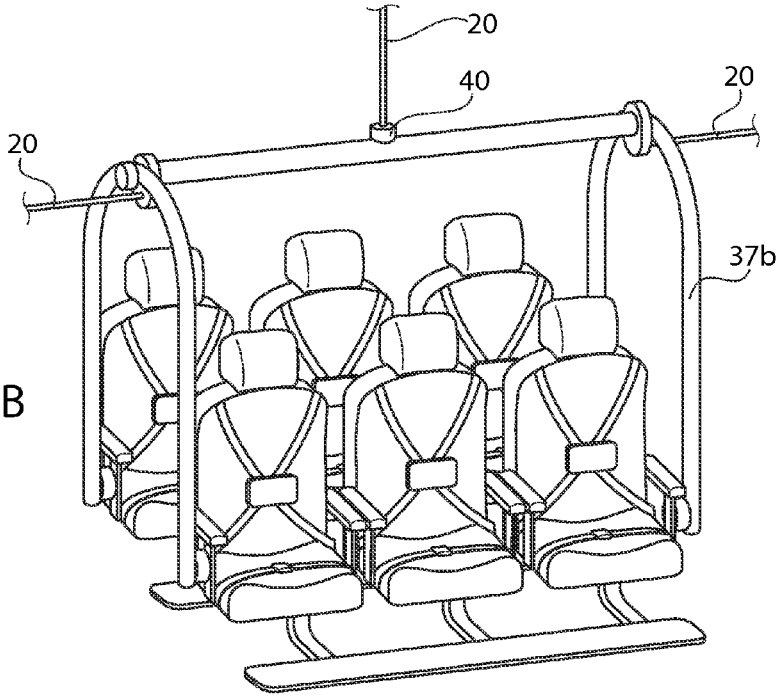

FIGS. 10A and 10B show alternative embodiments of the chairlift design 37 according and implementation. As shown, additional side cables 20 are added so as to allow the entire chairlift 37A to be pulled in a lateral direction while moving via cable 20. As with the previous embodiments, the rotation point of connection 40A provides the ability to spin the entire chairlift 37A while the other rotation points 40B enable the rotation of the row of seats. It is further contemplated that the cable 20 is attached to a winch motor system 24 (not shown) which would allow the chairlift 35 to be lowered to the ground for any reason, including, but not limited to loading people on and off, emergencies, etc. the side cables 20 could remain attached and simply be released by their respective motors during such lowering action, or alternatively, the side cables can have emergency releases that would detach the side cables to allow unobstructed lowering of the chairlift in the event on an emergency.

Figure 10C:
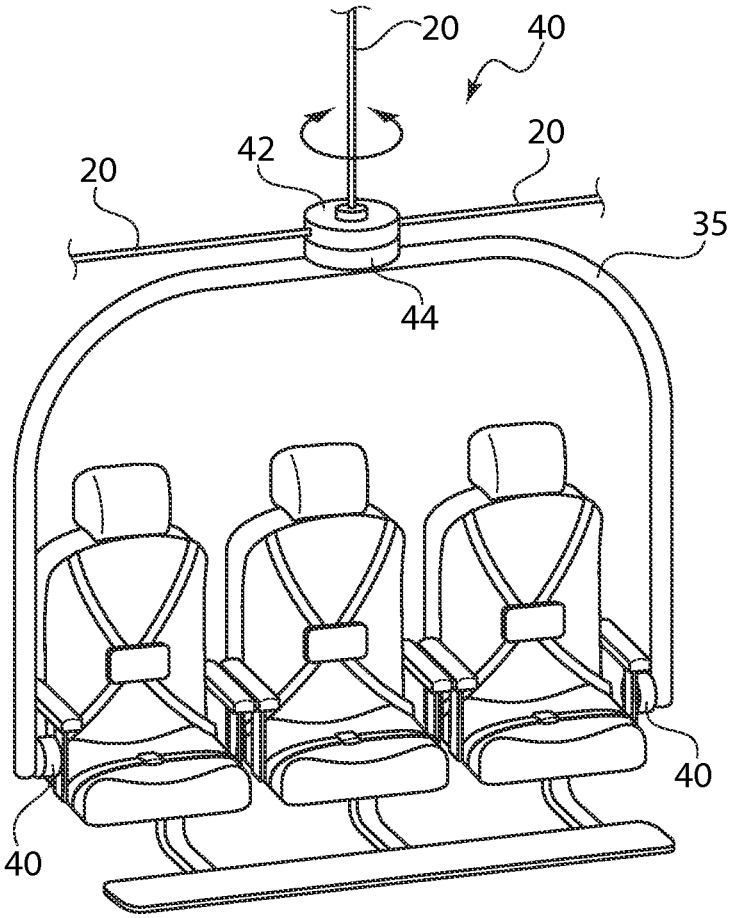
FIGS. 10C and 10D show another alternative implementation of the concepts of the people moving system according to the present principles.

FIG. 10C shows another alternative configuration of the people mover according to an implementation of the present principles. In this embodiment, the point of rotation 40 has an upper part 42 which does not rotate and a lower part 44 which does rotate. In this manner, additional side cables 20 can be connected to the stationary upper part 42 so as to provide lateral movement of the chairlift 35 while allowing the same to be moved up and down by the top cable 20, and also to be rotated about the axis formed at the connection point 40.

Figure 10D:
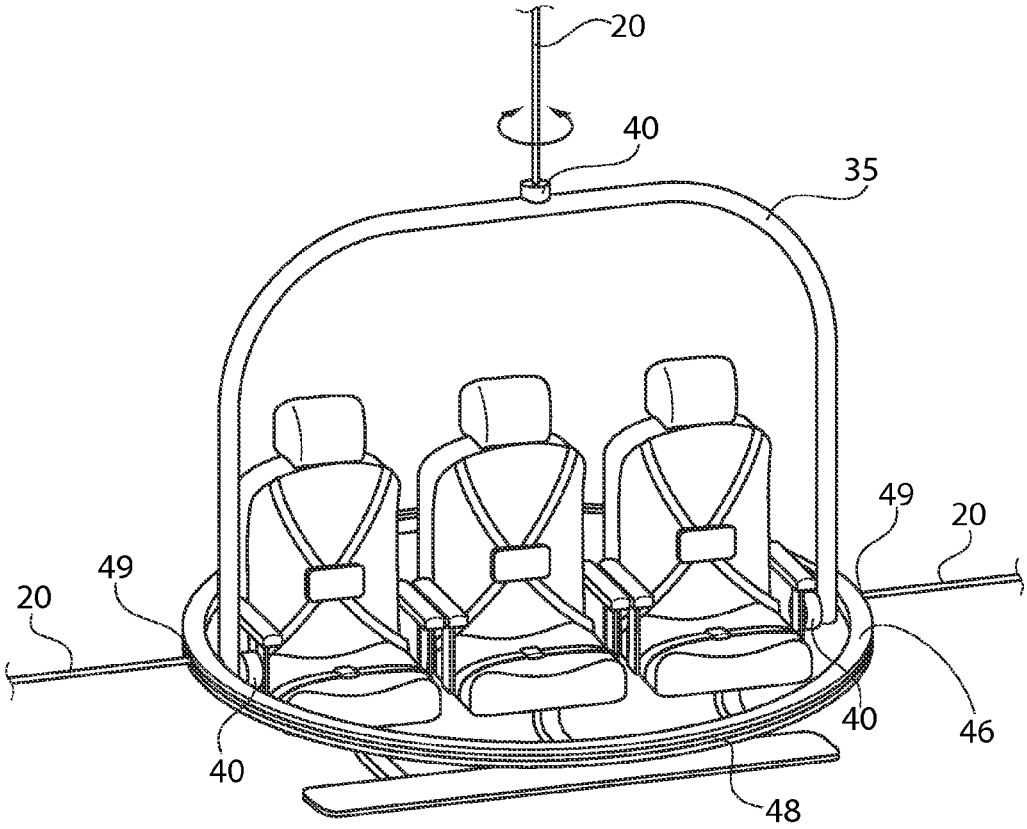

FIG. 10D shows another implementation where a ring 46 is positioned around a lower portion of the chairlift 35, and which can operate in two ways. In one implementation, the ring 46 is fixedly attached to the bottom of the chairlift 25 so that the chairlift 35 does not rotate within the ring. In this implementation, ring 46 will include an internal track 48 containing connection points 49 for side cables 20. The connection points 49 are configured so as to always stay within the track 48, but are freely movable within the plane formed by the ring/track 46/48. In this manner, when chairlift 35 is rotated about the top rotation point 40, the entire ring 46 will rotate with the chairlift 35, while side cables 20 can maintain their position within track 48 while the ring essentially rotates around them. This will allow side cables 20 to pull on the chairlift in one direction without interfering with any other movement of the chairlift 35 during operation of the same.

In another implementation, it is contemplated that the ring 46 can be rotatably connected to the chairlift 35 such that the cables 20 can be fixedly connected to the ring 36. In this embodiment, the rotation of the chairlift 35 by top rotation point 40 will cause the entire lift to rotate within the ring 46.

In all the embodiments shown in FIGS. 9A-10D, it is preferred that the seats within the people pods or chairlifts are free to move within the same. Those of skill in the art will appreciate that the seating systems for such people movers or amusement rides can include a plurality of actuators, rotation points, etc., which, in combination with the three (3) dimensional movement of the cable system can provide users with some of the most unique people moving or amusement ride experience.

Figure 11:
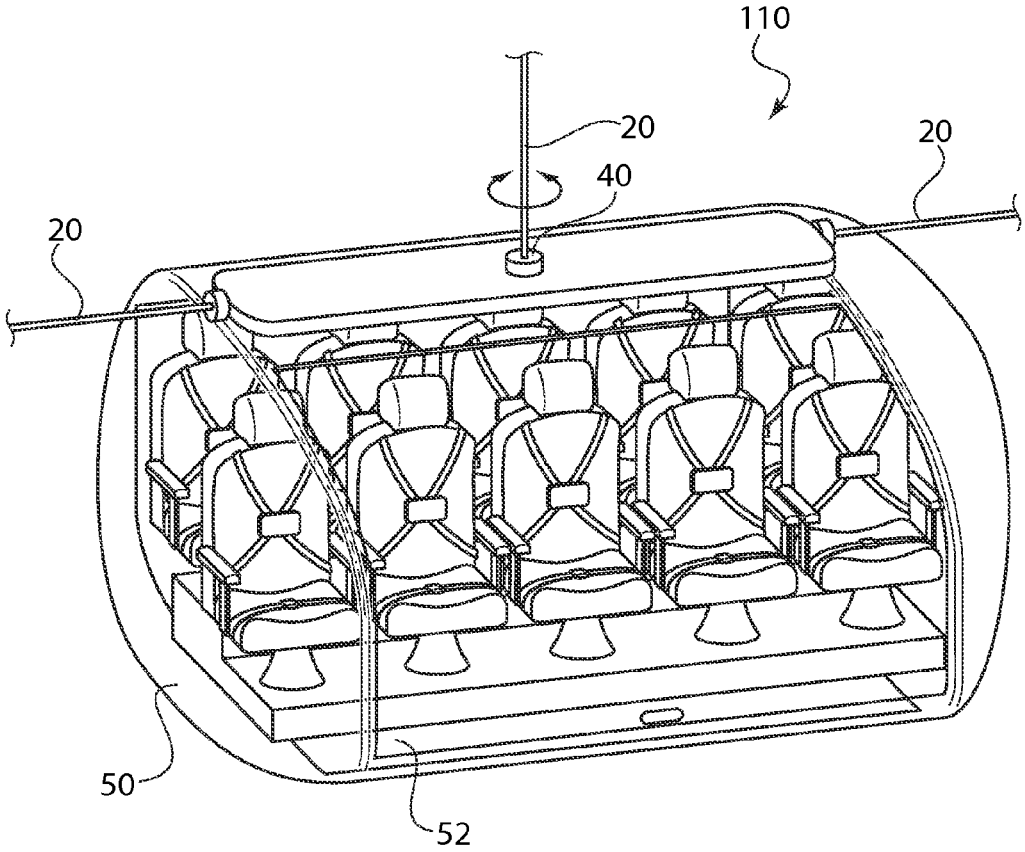
FIG. 11 shows yet another implementation of the people moving system according to the present principles.

FIG. 11 shows another alternative arrangement for the people pod 110 according to an implementation of the invention. In this embodiment, the pod 50 is completely enclosed and includes an access door 52 and a plurality of seats arranged in rows, or otherwise. It is contemplated that this people pod 110 with the connected cables 20 can be used for sightseeing in National parks or safari type applications and can be moved in three dimensions to provide a significantly more exciting and more interactive user experience.

These and other features and advantages of the present principles may be readily ascertained by one of ordinary skill in the pertinent art based on the teachings herein. It is to be understood that the teachings of the present principles may be implemented in various forms of hardware, software, firmware, special purpose processors, or combinations thereof.

Most preferably, the teachings of the present principles are implemented as a combination of hardware and software. Moreover, the software may be implemented as an application program tangibly embodied on a program storage unit. The application program may be uploaded to, and executed by, a machine comprising any suitable architecture. Preferably, the machine is implemented on a computer platform having hardware such as one or more central processing units ("CPU"), a random access memory ("RAM"), and input/output ("I/O") interfaces. The computer platform may also include an operating system and microinstruction code. The various processes and functions described herein may be either part of the microinstruction code or part of the application program, or any combination thereof, which may be executed by a CPU. In addition, various other peripheral units may be connected to the computer platform such as an additional data storage unit and a printing unit.

It is to be further understood that, because some of the constituent system components and methods depicted in the accompanying drawings are preferably implemented in software, the actual connections between the system components or the process function blocks may differ depending upon the manner in which the present principles are programmed. Given the teachings herein, one of ordinary skill in the pertinent art will be able to contemplate these and similar implementations or configurations of the present principles.

Although the illustrative embodiments have been described herein with reference to the accompanying drawings, it is to be understood that the present principles is not limited to those precise embodiments, and that various changes and modifications may be effected therein by one of ordinary skill in the pertinent art without departing from the scope or spirit of the present principles. All such changes and modifications are intended to be included within the scope of the present principles as set forth in the appended claims.

What is claimed is:

1. A people moving system comprising:

a people pod having at least one seat and including means for securing at least one person in the at least one seat;

a cable support system connected to the people pod, wherein the cable support system comprises at least one cable connected at a median point on the people pod; at least two cables connected at one end to the people pod;

a control system in communication with the cable support system and being configured to move the people pod in three dimensions by selectively controlling the cable support system and at least two motors, each motor being connected to the other end of one of said at least two cables, said at least two motors being in communication with said control system, said control system selectively controlling said at least two motors to pull on and/or release a respectively connected cable.

2. The people moving system according to claim 1, wherein said people pod comprises:

an inner portion having the at least one seat; and an outer frame connected to the cable support system.

3. The people moving system according to claim 1, wherein said people pod comprises a chairlift having at least one chair.

4. The people moving system according to claim 3, wherein said cable support system comprises:

at least one cable connected at one end to a top of the chairlift; and at least one motor connected to the other end of one of said at least one cable, said at least one motor being in communication with said control system, said control system selectively controlling said at least two motors to pull on and/or release a respectively connected cable.

5. The people moving system according to claim 4, further comprising a rotatable point of connection between the at least one cable and the chair lift, said rotatable point of connection enabling the selective rotation of the chairlift during operation.

6. The people moving system according to claim 4, further comprising a support for the at least one cable.

7. The people moving system according to claim 1, further comprising a support for each of said at least two cables, said supports being spaced apart from each other.

8. The people moving system according to claim 1, wherein the at least one seat further comprises a rotation mechanism capable of pivoting or rotating the at least one seat within the people pod.

9. A people moving system comprising:

a people pod having multiple seats, each seat having a harness system for securing a user therein;

a cable support system connected to the people pod configured to suspend the same in air, the cable support system comprising a plurality of cables connected at one end to the people pod and connected at another end to a plurality of motor/winch systems, wherein at least one of the plurality of cables is connected at a median point on the people pod; and a computer control system in communication with each of the plurality of motor/winch systems and being configured to control said plurality of motor/winch systems to move the people pod in three dimensions.

* * * * *